US006652170B1

(12) United States Patent
Arnold

(10) Patent No.: US 6,652,170 B1
(45) Date of Patent: Nov. 25, 2003

(54) PORTABLE PRINTER AND DATA ENTRY DEVICE ASSEMBLY

(75) Inventor: Gregory B. Arnold, Centerville, OH (US)

(73) Assignee: Paxar Americas, Inc., Dayton, OH (US)

( * ) Notice: Subject to any disclaimer, the term of this patent is extended or adjusted under 35 U.S.C. 154(b) by 364 days.

(21) Appl. No.: 09/665,813

(22) Filed: Sep. 20, 2000

Related U.S. Application Data

(63) Continuation-in-part of application No. 09/384,675, filed on Aug. 27, 1999.

(51) Int. Cl.[7] ..... B41J 3/36
(52) U.S. Cl. ..... 400/88; 400/693; 347/222
(58) Field of Search ..... 400/88, 691, 693; 347/222

(56) References Cited

U.S. PATENT DOCUMENTS

| | | | | | |
|---|---|---|---|---|---|
| D245,200 | S | * | 7/1977 | Packard | D18/11 |
| 4,727,245 | A | * | 2/1988 | Dobbins et al. | 235/432 X |
| 4,734,710 | A | * | 3/1988 | Sato et al. | 235/432 X |
| 4,788,658 | A | * | 11/1988 | Hanebuth | 361/684 |
| 5,047,615 | A | * | 9/1991 | Fukumoto et al. | 235/432 |
| 5,057,676 | A | * | 10/1991 | Komaki | 235/432 |
| 5,237,487 | A | * | 8/1993 | Dittmer et al. | 361/729 |
| 5,371,348 | A | * | 12/1994 | Kumar et al. | 235/472.02 |
| 5,468,947 | A | * | 11/1995 | Danielson et al. | 235/472.02 |
| 5,483,624 | A | | 1/1996 | Christopher et al. | 395/117 |
| 5,486,259 | A | | 1/1996 | Goodwin et al. | 156/384 |
| 5,488,558 | A | * | 1/1996 | Ohki | 701/207 |
| 5,808,283 | A | * | 9/1998 | Stanton et al. | 235/432 X |
| 5,816,725 | A | * | 10/1998 | Sherman et al. | 235/472.01 X |
| 5,930,770 | A | * | 7/1999 | Edgar | 235/462.43 X |
| 6,010,067 | A | * | 1/2000 | Elbaum | 235/380 |
| 6,195,589 | B1 | * | 2/2001 | Ketcham | 700/28 |

FOREIGN PATENT DOCUMENTS

| | | | | |
|---|---|---|---|---|
| EP | 0 191 495 | | 8/1986 | |
| EP | 0 199 252 | | 10/1986 | |
| EP | 0 200 945 | | 11/1986 | |
| EP | 0 250 910 | | 1/1988 | |
| JP | 5-108522 | * | 4/1993 | |
| JP | 11138911 A | * | 5/1999 | B41J/3/36 |
| JP | 2000025304 A | * | 1/2000 | B41J/29/38 |

OTHER PUBLICATIONS

Symbol Technologies, Inc. manual entitled SPT 1500, pp. 1 through 20, Copyright 1998.
Symbol Technologies, Inc. internet site, Product Information, SPT 1500 Palm Terminal Series, pp. 1 through 3, Mar. 23, 1999.
Axiohm Thermal Printer Mechanism, User's Manual THTP Series, Preliminary Issue, reference 3104660–FDE, Oct. 1998.
Symbol Technologies, Inc., internet site, MSR 3000 Magnetic Stripe Reader For SPT 1700 and PPT 2700 Pocketable Computers, pp. 1 through 3, Feb. 3, 2000.
Symbol Technologies, Inc., internet site, PPT 2700 Series Palm–size PC's, pp. 1 through 3, Feb. 3, 2000.
Fujitsu FTP 638 MCL100 (print head), two pages.
Publication, Semek, Model 908X, 608X, 408X (card reader), one page.
Solvepoint DockV™ and DockV Pro™ Instruction Guide, copyright 1999–2000, two pages.
PalmV(x)™ adapter for PalmIII accessories, one page.

* cited by examiner

*Primary Examiner*—Daniel J. Colilla
(74) *Attorney, Agent, or Firm*—Joseph J. Grass

(57) ABSTRACT

There is disclosed an assembly of a portable data entry device and a portable printer. The printer is hand-held and carries the data entry device. The data entry device includes a scanner and is located at the front portion of the printer. The printer has a space for accommodating a label roll and a print module which are located at the rear portion of the printer. The printer can be used with different data entry devices by use of adapters.

14 Claims, 5 Drawing Sheets

14'
12
23
21
6
14
10
11
L
13
15
14'
16
24
22
14
6

12
14
29
24
78
76
78'
20
21
28
25
19
R
39
41
16
14
29
30
A
77
17
31
26
25
18
11

77
12
62
23
75
31
30
27
26
71
72
40
39
W
35
R
36
70
68
59
67
68
69
32
34
38
33
37
C

84''
94
92''
91''
14''
12''
13''
84'
94
91'
88'
12'
13'
89
90
96
93
93'
92
91
88
84
84
100
92
88
94
C
91
88
80
82
81
83
86
107
14
16'
16
14'
15
12
13

PORTABLE PRINTER AND DATA ENTRY DEVICE ASSEMBLY

CROSS-REFERENCE TO RELATED APPLICATION

This is a continuation-in-part of co-pending application Ser. No. 09/384,675, filed Aug. 27, 1999.

BACKGROUND OF THE INVENTION

1. Field of the Invention

This invention relates to the fields of portable printers and portable data entry devices.

2. Brief Description of the Prior Art

The following prior art is made of record: U.S. Pat. Nos. 5,486,259 and 5,483,624; Symbol Technologies, Inc. manual entitled SPT 1500, pages 1 through 20, Copyright 1998; Symbol Technologies, Inc. internet site, Product Information, SPT 1500 Palm Terminal Series, pages 1 through 3, Mar. 23, 1999; Axiohm Thermal Printer Mechanism, User's Manual THTP Series, Preliminary Issue, reference 3104660-FDE, October, 1998.

SUMMARY OF THE INVENTION

The invention relates to a portable printer which can be coupled to a portable data entity device, and when so coupled the combination is a portable assembly which in general can be conveniently carried from place-to-place and which in particular is hand held.

The invention relates to an improved lightweight, portable, hand-held, user-friendly printer for reception of a lightweight, portable hand-held, user-friendly data entry device, and to a combination of such a printer and such a data entry device.

It is a feature of the invention to provide an improved printer adapted to receive portable data entry devices having different shapes. In particular, different models of portable data entry devices of the same or different manufacturers are shaped differently. In order to have various portable data entry device piggyback onto the printer without redesigning the printer, an adapter or adjuster is provided to accommodate differently shaped data entry devices.

According to a specific embodiment of the invention, a set of adapters is provided to receive correspondingly shaped portable data entry devices. Instead of redesigning the printer housing for each different data entry device, a different adapter are provided and each adapter is shaped to fit with a corresponding data entry device. Depending on the shape of the data entry device to be used, the adapter corresponding to that data entry device is assembled along with the remainder of the housing when the printer is being manufactured. Alternatively, in the event a printer has an adapter for one data entry device, the printer can be readily made to accommodate another and differently shaped data entry device by matching a different adapter to that other data entry device and substituting it on the printer housing.

It is another feature of the invention to provide an improved portable printer having a lower housing section, an upper housing section, and a compartment connected to the upper housing section for receiving a portable data entry device in piggyback fashion. One or more printed circuit boards are disposed between the upper and lower sections. There is a battery compartment in the lower housing section, and a card reader and a printer module including a print head are mounted on the circuit board. The card reader is disposed between the compartment and the printhead. An improved elastomeric grip includes an actuator and a data port plug. A specific embodiment of the printer includes an elongate hand-held housing having a front portion which has a compartment or pocket for receiving a data entry device. The housing also has a rear portion. There is space at the rear portion for receiving a roll of a label web. A print module or mechanism is disposed at the rear portion for printing on the label web, and the print module including a thermal print head and a platen roll cooperable with the print head. It is preferred that the housing compartment have an open top for access to the data entry device. The platen roll is preferably mounted on a cover for an access opening to the label roll space. A set of batteries and the print module are preferably mounted on an elongate circuit board disposed in the printer housing. The batteries are preferably located at the front portion of the printer housing. The compartment is preferably open-fronted and is channel-shaped for slidably, receiving the data entry device.

BRIEF DESCRIPTION OF THE DIAGRAMMATIC DRAWINGS

Figure 5:
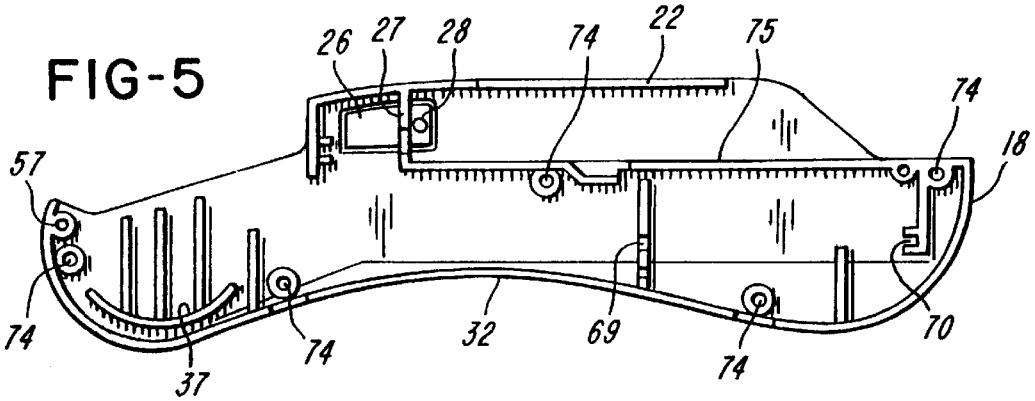
Figure 6:
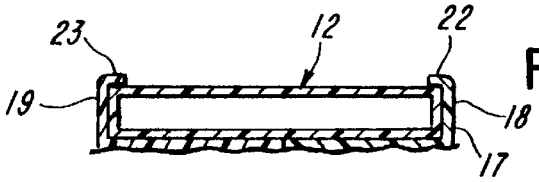
Figure 7:
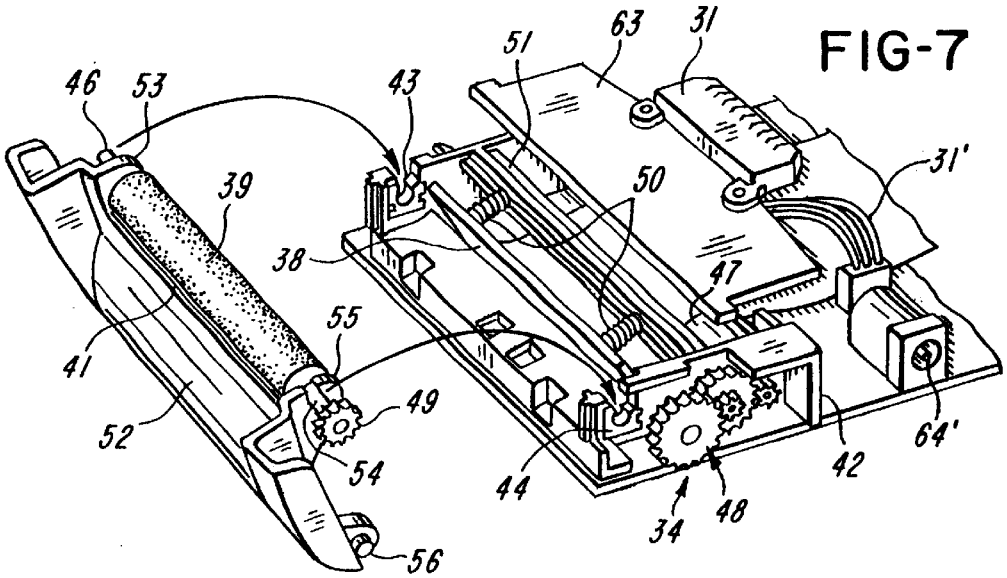
Figures 8, 9, 10, 11:
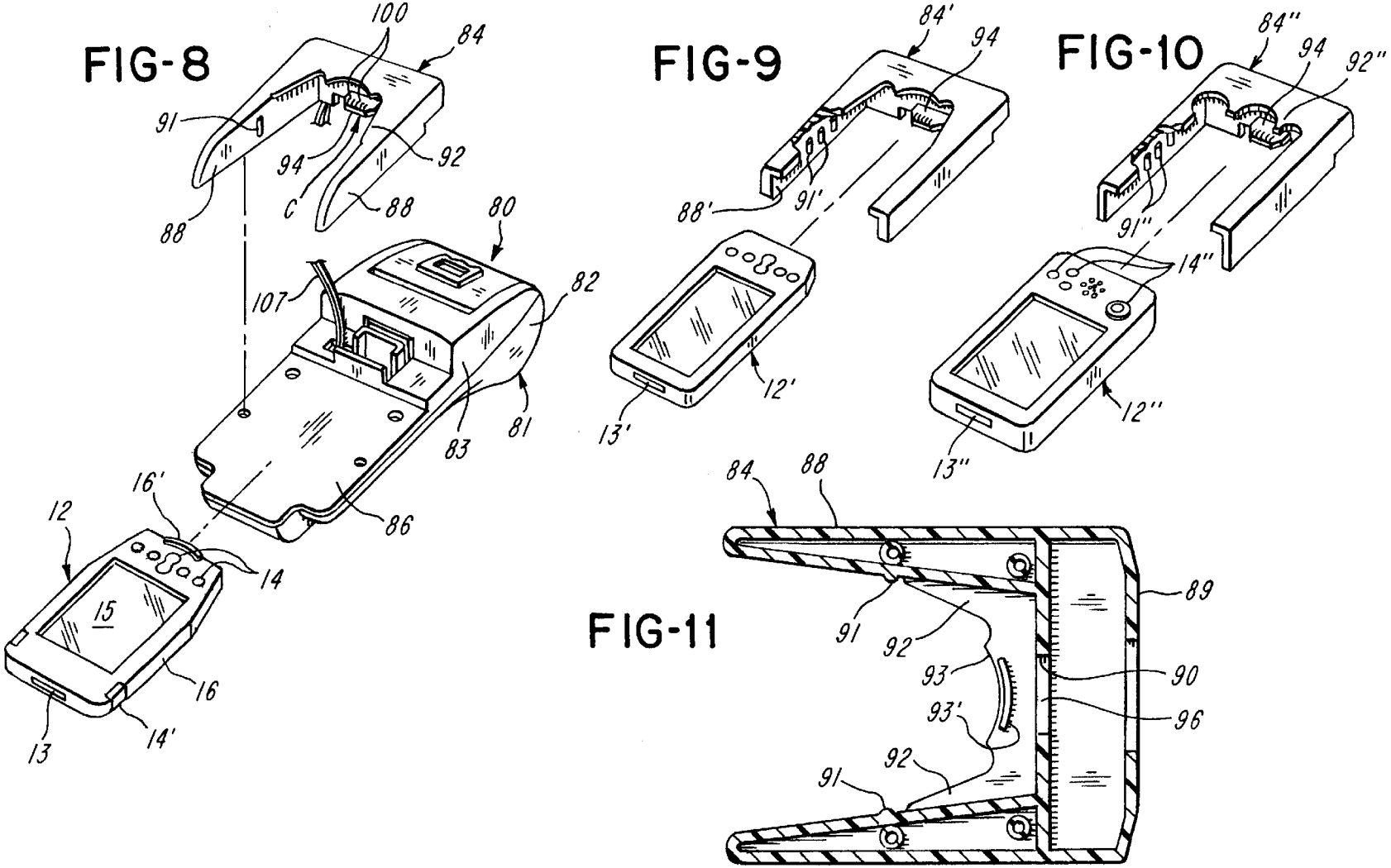
Figure 12:
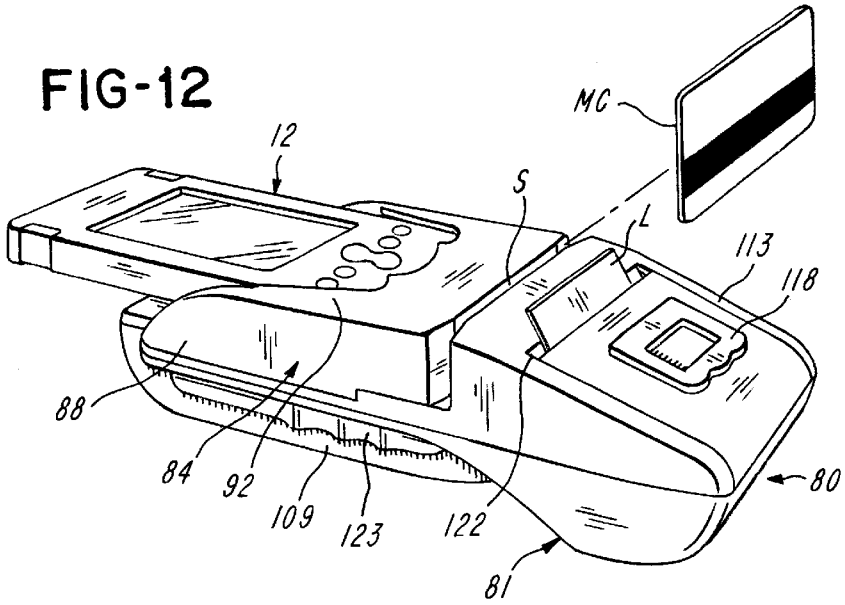
Figure 14:
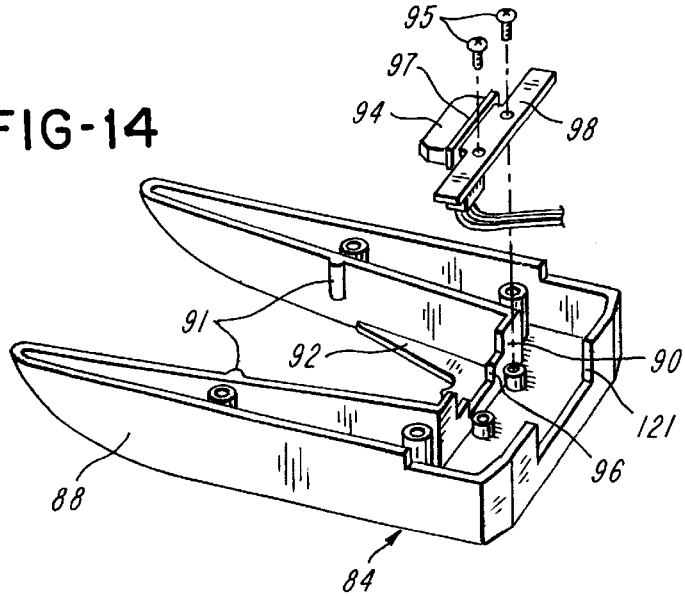
Figure 15:
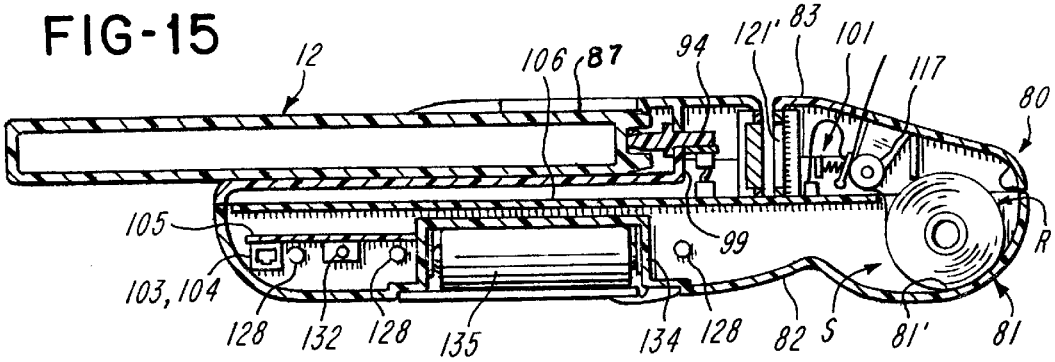
Figure 13:
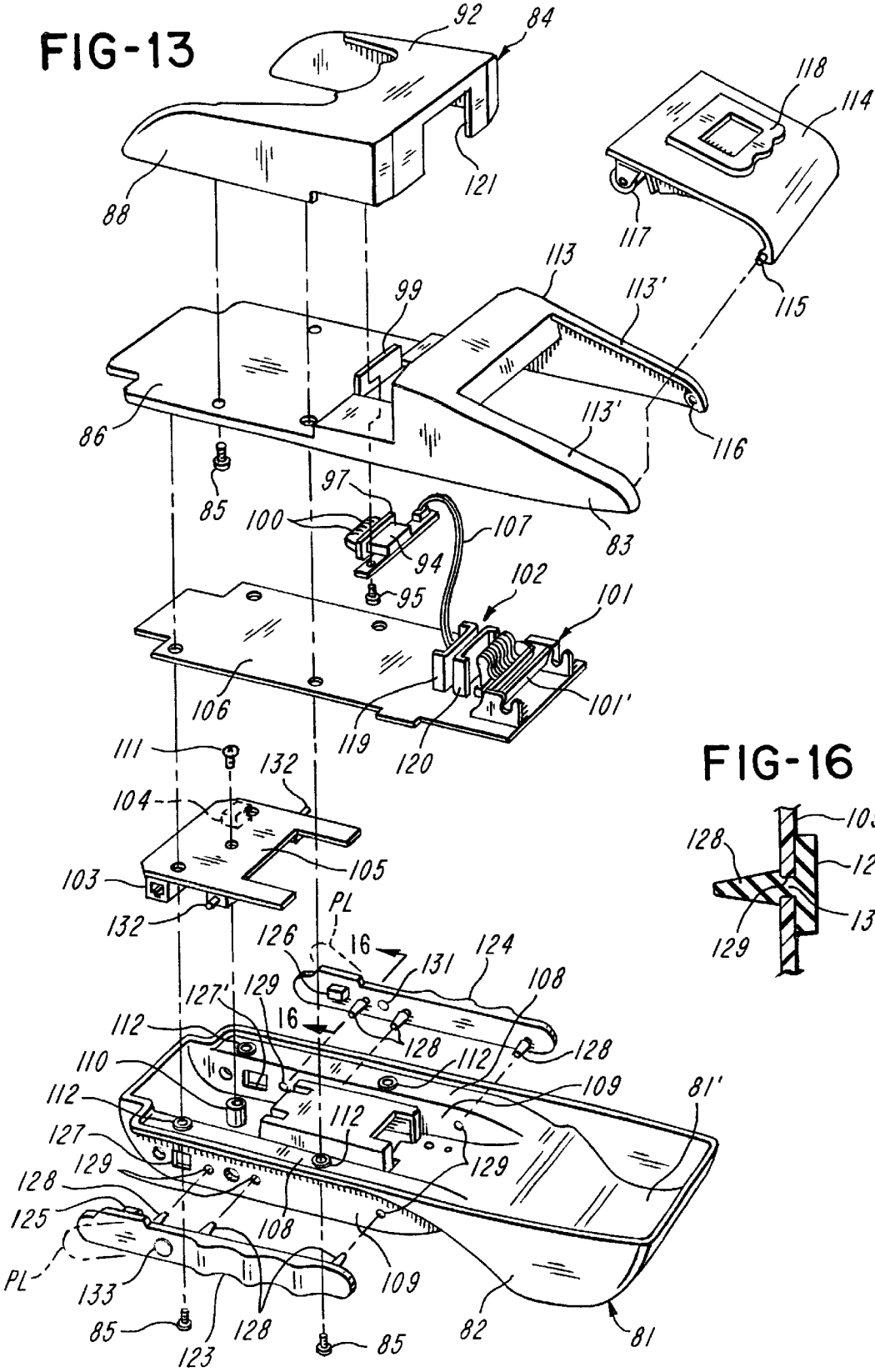
Figure 16:
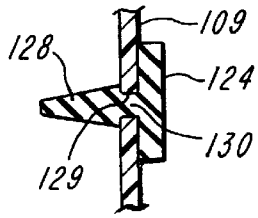

FIG. 5 in an elevational view of one of the two mirror-image housing sections;

FIG. 6 is a fragmentary sectional view illustrating the channel shape of the compartment for receiving the portable data entry device;

FIG. 7 is a fragmentary perspective view of the print module and the cover and the platen roll mounted by the cover;

FIG. 8 is a partially exploded perspective view of a portable printer including a compartment or adapter for receiving a portable data entry device;

FIG. 9 is an exploded perspective view of a different adapter for use with a different data entry device;

FIG. 10 is a perspective view similar to FIG. 9 but showing yet another different adapter for use with yet another different data entry device;

FIG. 11 is a bottom plan view, partly in section, of the adapter shown in FIG. 8;

FIG. 12 is a perspective view of the printer shown in FIG. 8 removably coupled to the portable data entry device;

FIG. 13 is an exploded perspective view of the printer shown in FIGS. 8 and 12;

FIG. 14 is a perspective view showing the underside of the adapter also shown in FIGS. 8 and 11, together with a connector;

FIG. 15 is a generally vertical sectional view of the printer and data entry device of the embodiment of FIGS. 8 and 11 through 14; and FIG. 16 is a sectional view taken at line 16—16 of FIG. 13.

DETAILED DESCRIPTION OF THE PREFERRED EMBODIMENTS

Figure 1:
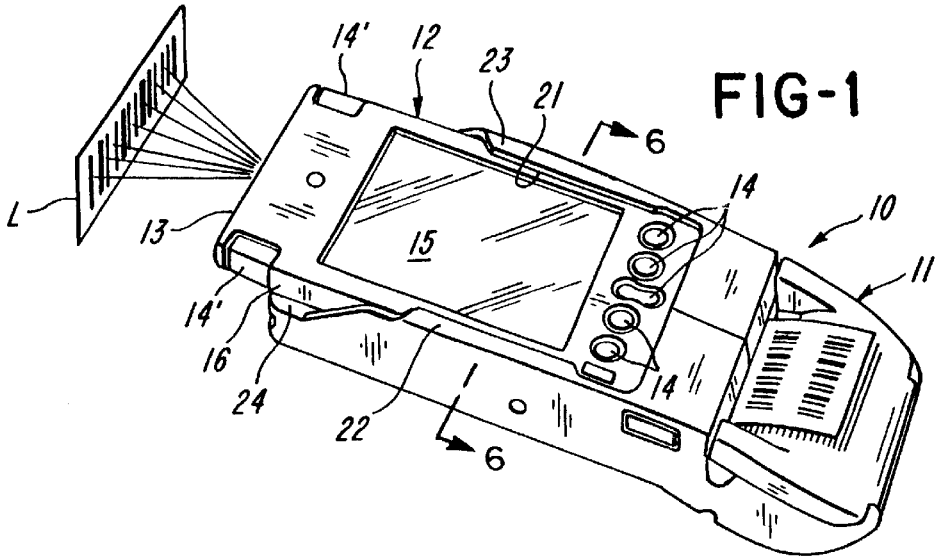
FIG. 1 is a perspective view of an assembly of a portable printer and portable data entry device, which is hand-held and portable, showing the portable data entry device scanning a bar-coded label.

With reference to FIG. 1, there is shown an assembly generally indicated at 10 of a portable printer generally indicated at 11 and a portable data entry device generally indicated at 12. The printer 11 and the device 12, individually, as well as the assembly 10 are portable and in particular are hand-held for ease of use. The device 12 includes a scanner 13 at its front end for scanning a bar-coded label L. The device 12 also has manually operable keys 14 and a display 15. The scanner 13, the keys 14 and the display 15 are housed in an elongate relatively thin housing 16. Manually depressing buttons 14' operates the scanner 13.

The printer 11 is shown to have an elongate housing 17 having opposed mirror-image housing sections 18 and 19. The front portion of the housing 17 has a compartment or space or pocket 20 for receiving and releasably holding the data entry device 12. The compartment 20 has an open top 21 to enable the keys to be operated and to enable the display 15 to be seen. The compartment 20 is channel-shaped as diagrammatically depicted in FIG. 6 to capture the data entry device 12. As shown, the housing 17 has flanges 22 and 23 which help retain the device 12 captive in the compartment 20. The front end of the compartment 20 is open as indicated at 24 to enable the device 12 to be slid into the compartment 20. The device 12 is releasably latched in the compartment 20 by opposed latches 25. The latches 25 are each comprised of a pad 26 flexibly secured to a wall 27. The pads 26 have opposed projections 28 which are received in recesses 29 in the housing 16 of the device 12. By simultaneously depressing both pads 26 rearwardly of the wall 27, the projections 28 are withdrawn from the recesses 29 which allows the device 12 to be slid out of the compartment 20.

The underside of the device 12 has a 10-pin connector 30 which cooperates with a mating 10-pin connector 31 on the housing 17. As the device 12 is slid into the compartment 20 in the direction of arrow A in FIG. 2, the connector 30 at the rear end of the device 12 connects with the connector 31 at the rear end of the compartment 20, thereby enabling the data entry device 12 to control the printer 11. The latches 25 are latched when the connectors 30 and 31 are connected.

Figure 3:
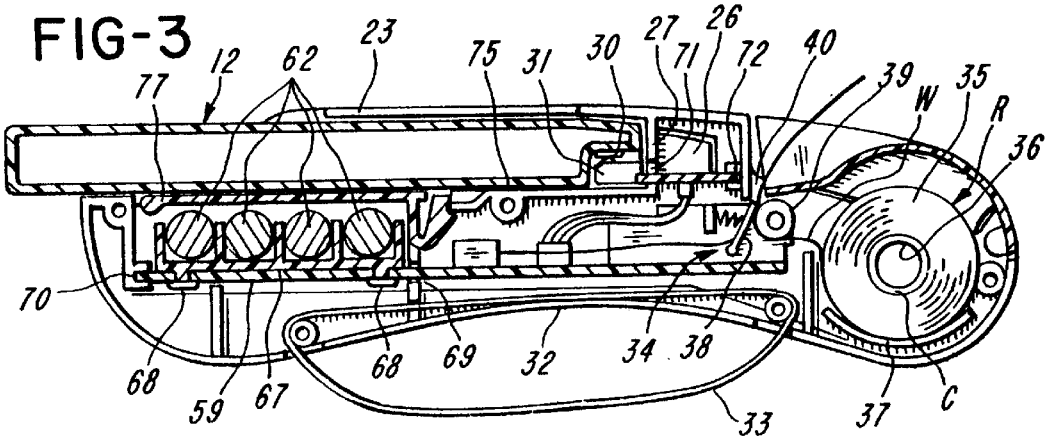
FIG. 3 is a generally vertical sectional view of the assembly shown in FIG. 1.

As is apparent from FIG. 3, the underside of the printer housing 17 has a hollow or concave surface 32 for receiving the palm of the user's hand. A strap 33 can fit about the back of the user's hand. The strap 33 can be a continuous loop of a hand as shown in FIG. 3. FIG. 3 also shows the device 12 diagrammatically and that a label roll R and a prior art print module or print mechanism generally indicated at 34 are disposed at a rear portion of the printer 11. The label roll R is illustrated as being comprised of a label web (or a web of labels) W received in space 35 in the housing 17. The roll R is suitably supported either at its central opening 36 or simply in a cradle 37 as shown. The web W passes from the roll R between a thermal print head 38 and a platen roll 39. The printed label web W exits the housing 17 at a slot 40 one side of which is formed by a tear edge 41.

FIG. 7 shows that the print module 34 comprises a frame 42 which has sockets 43 and 44. The module 34 includes a platen roll 39 having a shaft 46. The shaft 46 is releasably held in the sockets 43 and 44 in the FIG. 3 position. The module 34 further includes an electric motor 47 and gearing generally indicated at 48. The gearing 48 includes gear 49 on the shaft 46. Springs 50 which bear against a support 51 resiliently mount the print head 38.

Figure 2:
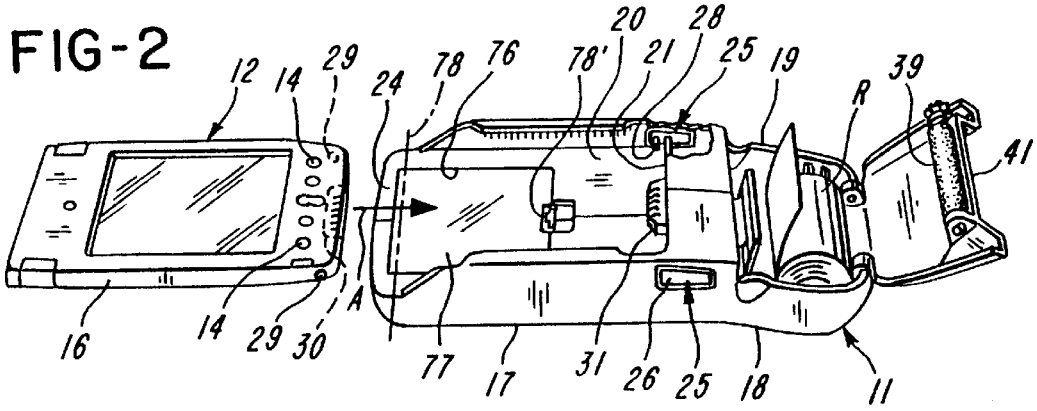
FIG. 2 is a partly exploded perspective view of the portable printer and the portable data entry device separated and with the cover open.

The platen roll 45 is rotatably mounted to a cover 52. In particular, the shaft 46 passes through a flange 53 and is removably received in a C-shaped cutout 54 in a flange 55. The end of the cover 52 opposite the platen 45 has a pair of outwardly extending projections 56 for receipt in opposed recesses 57 in the housing sections 18 and 19. Accordingly, the cover 52 is pivotally mounted for movement between a closed or operating position shown in FIGS. 1 and 3 and an open or non-operating position as illustrated in FIG. 2. It is apparent when the cover 52 is in the position shown in FIG. 2, a label roll R can be readily inserted into the space 35. If the roll R has a core C as shown the core can be readily removed. Also, the print head 38 and the platen roll 39 can be readily cleaned when the cover is in the open position. If required, the platen roll 45, its shaft 46 and its gear 49 can be readily replaced by snapping the portion of the shaft 46 between the flanges 55 and the gear 49 out of the socket 44, and pulling the other end of the shaft 46 out of the hole in the flange 53.

Figure 4:
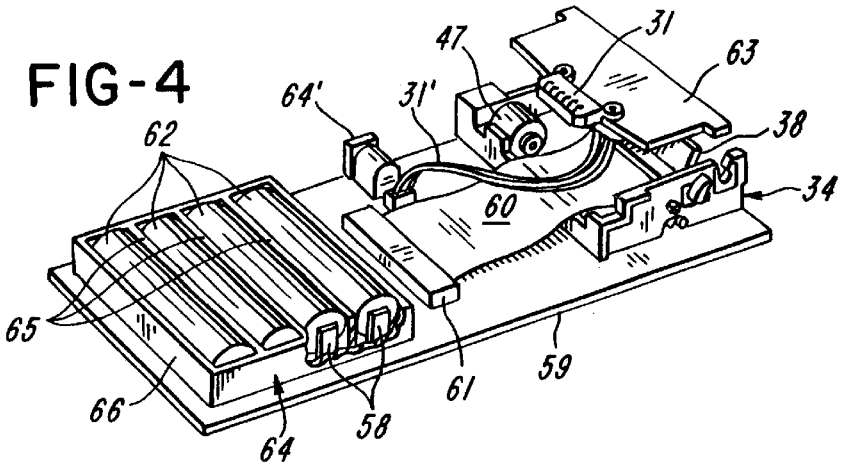
FIG. 4 is a perspective view of a printed circuit board of the printer with batteries and a print module shown mounted thereon.

As best shown in FIG. 4, the print module 34 and upstanding battery contacts 58 are mounted on a printed circuit board 59. The connector 31 is connected to the printed circuit board 59 via conductors 31'. A ribbon connector 60 connects the print head module 34, particularly the motor 47, the print head 38 and sensors (not shown) to the printed circuit board via a connector 61. There are four contacts 58 on each side of the printed circuit board 59 for releasable contact to four rechargeable batteries 62. The connector 31 which is mounted to a support 63 is connected to the printed circuit board 59. A port 64 accessible from outside the housing 17 is connected to the printed circuit board 59. The batteries 62 are held in a holder generally indicated at 64 which holds the batteries 62 in position but keep the batteries 62 from touching each other. The holder 64 maintains the batteries 62 aligned with opposed pairs of contacts 58. The holder 64 surrounds the outsides of all the batteries 62 as best shown in FIG. 4. The holder 64 has fin-like separators 65 joined to a peripheral wall 66 and to a bottom wall 67 (FIG. 3) The bottom wall 67 is connected to the printed circuit board 59 by integrally molded pins 68. The holder 64 is particularly beneficial in the event the assembly 10 or the printer 11 is dropped or otherwise impacted.

The printed circuit board 59 is captive between the housing sections 18 and 19 in transverse slots 69 and 70. The support 63 is received in slots 71 and 72. The housing sections 18 and 19 are connected by screws (not shown) received in aligned holes 74.

Floor 75 of the compartment 20 is provided with an access opening 76 which is closed off by a cover 77. The door 77 is pivotally mounted about a hinge axis 78 for movement between the closed position shown in FIG. 2 and an open position to provide access for loading and removing the batteries 24. The cover 77 is releasably held in the closed position by a releasable latch 78'.

The printer 11 is compact, by way of example not limitation, one embodiment of the printer 11 has a length of about 8.31 inches (211 mm), a height 2.38 inches (60 mm), a width of 3.38 inches (86 mm) and a weight of 0.9 pound (0.4 kg.); and the data entry device 12 has a length of 5.46 inches (140 mm), a height of 0.66 inch (17 mm), a width of 3.16 inches (81 mm), and a weight of 6.1 ounces (0.17 kg).

With reference to FIG. 8, there is shown the portable data entry device 12 and a printer 80. The printer 80 has an elongate housing 81 having a lower housing section 82 and an upper housing portion 83. An adapter or adjuster 84 is connected to the upper housing section 83 by a plurality of threaded fasteners 85. The adapter 84 together with upper surface 86 of the housing section 82 forms a compartment 87 for receiving the data entry device 12 in piggyback fashion as shown in FIGS. 12 and 15.

FIGS. 8, 9 and 10 show a set of three different adapters 84, 84' and 84" and a set of three corresponding different data entry devices 12, 12' and 12". Thus, the adapter 84 is shaped to fit or accommodate the data entry device 12, the adapter 84' is shaped to fit or accommodate the data entry device 12', and the adapter 84" is shaped to fit or accommodate the data entry device 12". As shown the data entry device 12' is narrower than the data entry device 12 and the data entry device 12" is thicker than the data entry devices 12 and 12'. It is thus apparent that the printer 81 can be readily modified or adjusted to accommodate different data entry devices.

The adapters 84, 84' and 84" are all shown to have a generally U-shaped configuration and are each preferably of one-piece molded construction. The adapter 84 has vertically extending wall sections 88 and 89 and a wall section 90. The wall sections 89 and 90 are parallel and the wall sections 88 are generally parallel to each other. Opposed faces of the wall sections 88 have frictional or gripper members 91 which grip the housing 16 of the data entry device 12. The housing 16 of the device 12 also has a lip or gripper 16' which cooperates with a ridge 93' on the adapter 84 to help releasably hold the device 12 to the printer 80. Alternatively, or in addition, it is preferred that the adapter 84 be comprised of an elastomeric material which will enable the data entry device to be yieldably held in the docked position in the compartment 87. Thus, the data entry device 12 is frictionally held in the compartment 87 by the gripper members 91 and 93'. The wall sections 88 and 90 are integrally joined to a horizontally extending U-shaped retaining flange 92. The compartment 87 is provided by the wall sections 88 and 90, the flange 92 and the upper surface 86 of the upper housing section 83. End edge portion 93 is sculptured or tailored to the data entry device 12 so that keys 14 can be operated while the data entry device 84 is docked in the compartment 87. The top portion of the adapter 84 is open, in the same way as the compartment 20 is open to enable the display 15 to be seen.

The data entry device 12' is narrower than the data entry device 12 and thus the distance between walls 88' is less than the distance between the walls 88 so as to fit or accommodate the data entry device 12' between wall sections 88'.

The data entry device 12" has a different arrangement of buttons 14" than the data entry devices 12 and 12' and as such the horizontal flange 9" is sculptured or tailored to allow access to the buttons 14".

In other respects the adapters 84' and 84" are identical to the adapter 84. As seen in FIGS. 8, 13 and 14, a coupling C in the form of a connector generally 94 is secured by screws 95 to the top or flange 92. The wall section 90 has a stepped opening 96 (FIG. 14). The connector 94 has a vertical collar 97 and a horizontal bar 98. The wall 90 is positioned between the collar 97 and the bar 98 to help hold the connector 94 in position on the adapter 84. The connector 94 is also positioned against an upstanding projection 99 on the upper housing section 83. The front upper portion of the connector 94 has a plurality of contacts 100 for contacting mating contacts on the data entry device 12.

As seen in FIG. 12 for example, the printer 80 and the data entry device 12 are used in the same manner as in the embodiment of FIGS. 1 through 7. The data entry device 12 is disposed at a front portion of the printer housing 81. A printer module 101 and space S defined by a surface 81' for mounting a label supply roll R are disposed at the rear portion of the housing 81 and a magnetic card reader generally 102 is disposed between the data entry device receiving compartment 87 and the print head module 101 with its print head 101'. So, therefore, data can be printed by the printer 80 from data received from the data entry device 12, from the card reader 102 or through data ports 103 or 104 (FIG. 13).

The data ports 103 and 104 are mounted on a U-shaped printed circuit board 105. The printed circuit board 105 is electrically connected to a printed circuit board 106. Conductor 107 is shown to connect the connector 94 to the printed circuit board 106. The print head module 101 and the card reader 102 are mounted on and are electrically connected to the printed circuit board 106.

As shown in FIG. 13, the housing section 81 has a pair of longitudinally extending horizontal lands 108 which support side margins of the printed circuit board 106. The lands 108 are joined to a pair of parallel, vertical, opposed walls 109. The printed circuit board 105 is secured to a rigid post 110 by a screw 111 between the walls 109. The lands 108 have holes 112 through which screws 85 pass into the adapter 84. In this way the adapter 84 is held securely to the lower housing section 82 and to the upper housing section 83.

The upper housing section has an inclined portion 113 with a door 114 pivotally mounted on spaced arms 113' by two studs 115 received in opposed holes 116. The door 114 rotatably mounts a platen roller 117 which cooperates with the print head 101' as shown in FIG. 15. The door 114 has a flexible handle 118 for assisting the user in opening the door 114.

The card reader 101 is used to read a magnetic card MC. The adapter 84 and the adjacent wall 113" of the inclined portion 113 are spaced to provide a slot S' so that the magnetic card MC can pass therethrough between members 119 and 120. The card reader 102 has a pair of U-shaped members 119 and 120. The member 119 is positioned at opening 121 in the adapter 84. The other member 120 is positioned at an opening 121' of the inclined portion 113 (FIG. 15). When the print head module 101 prints, the printed labels L issue through an opening 122 in the inclined portion 113.

As best shown in FIG. 13, a pair of manually engageable members 123 and 124 are secured to the outside surfaces of walls 109. The members 123 and 124 are identical except that the member 123 has a differently shaped rectangular plug 125 from rectangular plug 126 of the member 124. The plug 125 fits into a hole 127 and the plug 126 fits into a hole 127. The members 123 and 124 are each of one-piece molded, resilient, elastomeric construction. Each member 123 and 124 has inner surfaces with three identical undercut projections 128. The projections 128 fit through holes 129 in the walls 109 and are captured at the undercut 130 as best shown in FIG. 16. The inside surfaces of the members 123 and 124 from which the projections 128 extend also have a raised or convex portion 131. Each convex portion 131 is aligned with a switch 132. If either switch 132 is depressed the scanner 13 will be operated to read the bar code on the label L. Convex portions 133 on the outside surfaces of each of the members 123 and 124 are aligned with the convex portions 131 and are depressible by the user to operate the switches 132. The plugs 125 and 126 are preferably positioned in respective openings 127 and 127' when the ports 103 and 104 are not in use. However, by flexing the members 123 and/or 124 to their phantom line positions shown at PL in FIG. 13, the respective ports 103 and 104 can be uncovered for use.

The lower housing section has a compartment 134 for receiving a battery 135 connected to the printed circuit board for powering the printer and its electronics. A door 136 closes the compartment 134.

By way of example, not limitation, the print head module 101 can be a Fujitsu FTP 638MCL100 print head module and the card reader 102 can be a Semek 4083-0 card reader.

Other embodiments and modifications of the invention will suggest themselves to those skilled in the art, and all such of these as come within the spirit of this invention are included within its scope as best defined by the appended claims.

What is claimed is:

1. In combination: a portable printer, at least two differently shaped portable entry devices, each portable entry device including a scanner for scanning bar codes and a data entry device housing for the scanner, the portable printer including a printer housing having a front portion, a set of at least two different adapters each shaped to receive one of the data entry devices, one of the adapters being disposed at the front portion, the printer housing having a rear portion, the printer housing providing space at the rear portion for receiving a roll of a label web, a print head disposed at the rear portion of the printer housing, and a data coupling between the received data entry device and the printer.

2. In combination: a portable printer, at least two differently shaped portable data entry devices, the printer including a printer housing, a print head disposed in the housing, at least two different adapters each shaped to receive one of the data entry devices, the printer housing including one of the adapters, and a data coupling between the received data entry device and the printer.

3. In the combination defined in claim 2, including a compartment on the housing for a battery to power the print head.

4. A portable printer, comprising: a housing, a print head in the housing, a set of at least two different shaped adapters, the housing including one of the adapters, and each adapter being shaped to receive a correspondingly shaped portable data entry device.

5. A portable printer as defined in claim 4, wherein each adapter is generally U-shaped.

6. A portable printer as defined in claim 4, and a fastener for connecting one of the adapters to the remainder of the housing.

7. A portable printer as defined in claim 4, wherein each adapter has an open top portion to allow operation of the portable data entry device.

8. A portable printer as defined in claim 4, wherein each adapter has an open front portion.

9. A portable printer as defined in claim 4, including a battery for powering the print head.

10. A portable printers defined in claim 4, wherein each adapter has an open front portion and an open top portion.

11. A portable printer as defined in claim 4, including a data connector secured to the adapter on the housing.

12. A portable printer as defined in claim 4, including a frictional member for releasably holding a data entry in the adapter on the housing.

13. A portable printer as defined in claim 4, wherein each adapter includes a flange for helping to removably retain a data entry device on the housing.

14. A portable printer as defined in claim 4, wherein each flange is generally U-shaped.

* * * * *